US009447929B2

(12) United States Patent
Jiang

(10) Patent No.: US 9,447,929 B2
(45) Date of Patent: Sep. 20, 2016

(54) LED TUBE LAMP

(71) Applicant: JIAXING SUPER LIGHTING ELECTRIC APPLIANCE CO.,LTD, Zhejiang (CN)

(72) Inventor: Tao Jiang, Zhejiang (CN)

(73) Assignee: JIAXING SUPER LIGHTING ELECTRIC APPLIANCE CO., LTD, Zheijiang (CN)

( * ) Notice: Subject to any disclaimer, the term of this patent is extended or adjusted under 35 U.S.C. 154(b) by 0 days.

(21) Appl. No.: 15/056,121

(22) Filed: Feb. 29, 2016

(65) Prior Publication Data

US 2016/0178138 A1 Jun. 23, 2016

Related U.S. Application Data

(63) Continuation-in-part of application No. 14/865,387, filed on Sep. 25, 2015.

(30) Foreign Application Priority Data

| | | |
|---|---|---|
| Sep. 28, 2014 | (CN) | 2014 1 0507660 |
| Sep. 28, 2014 | (CN) | 2014 1 0508899 |
| Nov. 6, 2014 | (CN) | 2014 1 0623355 |
| Dec. 5, 2014 | (CN) | 2014 1 0734425 |
| Feb. 12, 2015 | (CN) | 2015 1 0075925 |
| Mar. 27, 2015 | (CN) | 2015 1 0136796 |
| May 19, 2015 | (CN) | 2015 1 0259151 |
| Jun. 17, 2015 | (CN) | 2015 1 0338027 |
| Jun. 26, 2015 | (CN) | 2015 1 0372375 |
| Jun. 26, 2015 | (CN) | 2015 1 0373492 |
| Aug. 7, 2015 | (CN) | 2015 1 0482944 |
| Aug. 8, 2015 | (CN) | 2015 1 0483475 |
| Sep. 2, 2015 | (CN) | 2015 1 0555543 |

(51) Int. Cl.
*H01J 7/44* (2006.01)
*H01J 13/46* (2006.01)

(Continued)

(52) U.S. Cl.
CPC ..... *F21K 9/175* (2013.01); *F21V 3/0427* (2013.01); *F21V 3/0472* (2013.01); *F21V 7/22* (2013.01); *F21V 17/101* (2013.01); *F21V 23/02* (2013.01); *F21Y 2103/003* (2013.01)

(58) Field of Classification Search
None
See application file for complete search history.

(56) References Cited

U.S. PATENT DOCUMENTS

| | | | |
|---|---|---|---|
| 5,575,459 | A | 11/1996 | Anderson |
| 5,921,660 | A | 7/1999 | Yu |

(Continued)

FOREIGN PATENT DOCUMENTS

| | | | |
|---|---|---|---|
| CN | 200965185 | Y | 10/2007 |
| CN | 101715265 | A | 5/2010 |

(Continued)

OTHER PUBLICATIONS

PCT Search Report for International Application No. PCT/CN2015/090859 dated Jan. 4, 2016.

(Continued)

*Primary Examiner* — Anh Tran
(74) *Attorney, Agent, or Firm* — Andrew M. Calderon; Roberts Mlotkowski Safran Cole & Calderon, P.C.

(57) ABSTRACT

An LED tube lamp including a glass lamp tube, an LED light strip disposed inside the glass lamp tube, and an end cap attached over an end of glass lamp tube is disclosed. The glass lamp tube is covered by a heat shrink sleeve. The inner surface of the glass lamp tube is formed with a rough surface or a light scattering region. The glass lamp tube includes a main body region, a rear end region, and a two-arc-shaped transition region connecting the main body region and the rear end region. The LED light strip includes a bendable circuit sheet being longer than the glass lamp tube to form a freely extending end portion.

20 Claims, 3 Drawing Sheets

(51) Int. Cl.

| | |
|---|---|
| ***H01J 17/34*** | (2006.01) |
| ***H01J 19/78*** | (2006.01) |
| ***H01J 23/16*** | (2006.01) |
| ***H01J 29/96*** | (2006.01) |
| ***H01K 1/62*** | (2006.01) |
| ***F21K 99/00*** | (2016.01) |
| ***F21V 7/22*** | (2006.01) |
| ***F21V 17/10*** | (2006.01) |
| ***F21V 3/04*** | (2006.01) |
| ***F21V 23/02*** | (2006.01) |
| *F21Y 103/00* | (2016.01) |

(56) References Cited

U.S. PATENT DOCUMENTS

| | | | | |
|---|---|---|---|---|
| 6,127,783 | A | 10/2000 | Pashley | |
| 6,609,813 | B1 | 8/2003 | Showers | |
| 6,796,680 | B1 | 9/2004 | Showers | |
| 7,033,239 | B2 | 4/2006 | Cunkelman | |
| 8,360,599 | B2 | 1/2013 | Ivey | |
| 8,579,463 | B2 | 11/2013 | Clough | |
| 2002/0044456 | A1 | 4/2002 | Balestriero | |
| 2002/0176262 | A1 | 11/2002 | Tripathi | |
| 2003/0102819 | A1 | 6/2003 | Min | |
| 2003/0231485 | A1 | 12/2003 | Chien | |
| 2004/0095078 | A1 | 5/2004 | Leong | |
| 2004/0189218 | A1 | 9/2004 | Leong | |
| 2005/0128751 | A1 | 6/2005 | Roberge | |
| 2005/0162850 | A1* | 7/2005 | Luk | F21S 4/26 362/227 |
| 2005/0207166 | A1 | 9/2005 | Kan | |
| 2005/0213321 | A1 | 9/2005 | Lin | |
| 2007/0001709 | A1 | 1/2007 | Shen | |
| 2007/0145915 | A1 | 6/2007 | Roberge | |
| 2007/0210687 | A1 | 9/2007 | Axelsson | |
| 2007/0274084 | A1 | 11/2007 | Kan | |
| 2008/0030981 | A1 | 2/2008 | Mrakovich | |
| 2008/0192476 | A1 | 8/2008 | Hiratsuka | |
| 2008/0278941 | A1 | 11/2008 | Logan | |
| 2009/0161359 | A1 | 6/2009 | Siemiet | |
| 2009/0290334 | A1* | 11/2009 | Ivey | F21K 9/17 362/219 |
| 2010/0103673 | A1 | 4/2010 | Ivey et al. | |
| 2010/0253226 | A1 | 10/2010 | Oki | |
| 2011/0038146 | A1 | 2/2011 | Chen | |
| 2011/0057572 | A1 | 3/2011 | Kit et al. | |
| 2011/0090684 | A1 | 4/2011 | Logan | |
| 2011/0148313 | A1 | 6/2011 | Ramaker | |
| 2011/0216538 | A1 | 9/2011 | Logan | |
| 2012/0069556 | A1 | 3/2012 | Bertram | |
| 2012/0106157 | A1 | 5/2012 | Simon | |
| 2012/0153873 | A1 | 6/2012 | Hayashi et al. | |
| 2012/0235578 | A1 | 9/2012 | Miller | |
| 2013/0050998 | A1 | 2/2013 | Chu et al. | |
| 2013/0170245 | A1 | 7/2013 | Hong et al. | |
| 2013/0182425 | A1 | 7/2013 | Seki | |
| 2013/0200797 | A1 | 8/2013 | Timmermans | |
| 2013/0313983 | A1* | 11/2013 | Radermacher | F21K 9/17 315/187 |
| 2014/0071667 | A1 | 3/2014 | Hayashi et al. | |
| 2014/0153231 | A1 | 6/2014 | Bittmann | |
| 2014/0226320 | A1 | 8/2014 | Halliwell et al. | |
| 2015/0009688 | A1 | 1/2015 | Timmermans et al. | |
| 2016/0081147 | A1* | 3/2016 | Guang | F21V 23/002 315/123 |

FOREIGN PATENT DOCUMENTS

| | | | |
|---|---|---|---|
| CN | 102155642 | A | 8/2011 |
| CN | 202125774 | U | 1/2012 |
| CN | 102355780 | A | 2/2012 |
| CN | 102518972 | | 6/2012 |
| CN | 102518972 | A | 6/2012 |
| CN | 102932997 | A | 2/2013 |
| CN | 203240337 | U | 10/2013 |
| CN | 203797382 | | 8/2014 |
| CN | 203927469 | | 11/2014 |
| CN | 204268162 | | 4/2015 |
| CN | 204300737 | U | 4/2015 |
| CN | 104595765 | A | 5/2015 |
| CN | 204420636 | U | 6/2015 |
| WO | WO 2011/132120 | A1 | 10/2011 |
| WO | WO 2013/125803 | A1 | 8/2013 |
| WO | WO 2014/001475 | A1 | 1/2014 |
| WO | WO 2015/036478 | A1 | 3/2015 |

OTHER PUBLICATIONS

PCT Search Report for International Application No. PCT/CN2015/090814 dated Dec. 30, 2015.

* cited by examiner

LED TUBE LAMP

CROSS-REFERENCE TO RELATED APPLICATIONS

This application is a continuation-in-part (CIP) of application Ser. No. 14/865,387, filed on 2015 Sep. 25, which claims priority to Chinese Patent Applications No. CN 201410507660.9 filed on 2014 Sep. 28; CN 201410508899.8 filed on 2014 Sep. 28; CN 201410623355.6 filed on 2014 Nov. 6; CN 201410734425.5 filed on 2014 Dec. 5; CN 201510075925.7 filed on 2015 Feb. 12; CN 201510136796.8 filed on 2015 Mar. 27; CN 201510372375.5 filed on 2015 Jun. 26; CN 201510259151.3 filed on 2015 May 19; CN 201510338027.6 filed on 2015 Jun. 17; CN 201510373492.3 filed on 2015 Jun. 26; CN 201510482944.1 filed on 2015 Aug. 7; CN 201510483475.5 filed on 2015 Aug. 8; and CN 201510555543.4 filed on 2015 Sep. 2, the disclosures of which are incorporated herein in their entirety by reference.

FIELD OF THE INVENTION

The present disclosure relates to illumination devices, and more particularly to an LED tube lamp and its components including the light sources, electronic components, and end caps.

BACKGROUND OF THE INVENTION

LED lighting technology is rapidly developing to replace traditional incandescent and fluorescent lightings. LED tube lamps are mercury-free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

Typical LED tube lamps have a lamp tube, a circuit board disposed inside the lamp tube with light sources being mounted on the circuit board, and end caps accompanying a power supply provided at two ends of the lamp tube with the electricity from the power supply transmitting to the light sources through the circuit board. However, existing LED tube lamps have certain drawbacks.

First, the typical circuit board is rigid and allows the entire lamp tube to maintain a straight tube configuration when the lamp tube is partially ruptured or broken, and this gives the user a false impression that the LED tube lamp remains usable and is likely to cause the user to be electrically shocked upon handling or installation of the LED tube lamp.

Second, the rigid circuit board is typically electrically connected with the end caps by way of wire bonding, in which the wires may be easily damaged and even broken due to any move during manufacturing, transportation, and usage of the LED tube lamp and therefore may disable the LED tube lamp.

Third, the lamp tube and the end caps are often secured together by using adhesive, and it is hard to prevent the buildup of excess (overflown) adhesive residues. This may cause light blockage as well as an unpleasant aesthetic appearance. In addition, a large amount of manpower is required to clean off the excessive adhesive buildup, create a further production bottleneck and inefficiency. Also, bad heat dissipation of the power supply components inside the end caps can cause a high temperature and therefore reduces life span of the adhesive and simultaneously disables the adhesion between the lamp tube and the end caps, which may decrease the reliability of the LED tube lamp.

Fourth, the typical lamp tube is a long cylinder sleeved with the end caps at ends by means of adhesive, in which the end caps each has a larger diameter than that of the lamp tube. In this way, a packing box for the lamp tube—which is also typically in cylinder shape—will contact only the end caps such that only the end caps are supported and the connecting part between the end caps and the lamp tube is apt to break, such as disclosed LED tube lamp in a published US patent application with publication no. US 2014226320 and a published CN patent application with publication no. CN 102518972. To address this issue, a published US patent application with publication no. US 20100103673 discloses an end cap that is sealed and inserted into a glass made lamp tube. However, this kind of lamp tube is subjected to inner stresses at its ends and may easily break when the ends are subjected to external forces, which may lead to product defects and quality issues.

Fifth, grainy visual appearances are also often found in the aforementioned conventional LED tube lamp. The LED chips spatially arranged on the circuit board inside the lamp tube are considered as spot light sources, and the lights emitted from these LED chips generally do not contribute uniform illuminance for the LED tube lamp without proper optical manipulation. As a result, the entire tube lamp would exhibit a grainy or non-uniform illumination effect to a viewer of the LED tube lamp, thereby negatively affecting the visual comfort and even narrowing the viewing angles of the lights. As a result, the quality and aesthetics requirements of average consumers would not be satisfied. To address this issue, the CN patent application with application no. CN 201320748271.6 discloses a diffusion tube is disposed inside a glass lamp tube to avoid grainy visual effects.

However, the disposition of the diffusion tube incurs an interface on the light transmission path to increase the likelihood of total reflection and therefore decrease the light outputting efficiency. In addition, the optical rotatory absorption of the diffusion tube decreases the light outputting efficiency.

Accordingly, the prevent disclosure and its embodiments are herein provided.

SUMMARY OF THE INVENTION

It's specially noted that the present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and are described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED tube lamp or a portion thereof.

The present invention provides a novel LED tube lamp, and aspects thereof.

The present invention provides an LED tube lamp. According to one embodiment, the LED tube lamp includes a glass lamp tube, an end cap, a power supply, and an LED light strip. The glass lamp tube is covered by a heat shrink sleeve. The inner surface of the glass lamp tube is formed with a rough surface and the roughness of the inner surface is higher than that of the outer surface. The glass lamp tube also includes a main body region, a rear end region, and a two-arc-shaped transition region connecting the main body region and the rear end region. The end cap is disposed at one end of the glass lamp tube and the power supply is provided inside the end cap. The LED light strip is disposed inside the glass lamp tube with a plurality of LED light sources mounted on the LED light strip. The LED light strip has a bendable circuit sheet mounted on the inner surface of the glass lamp tube. The bendable circuit sheet electrically connects the LED light sources with the power supply. The length of the bendable circuit sheet is larger than the length of the glass lamp tube to form a freely extending end portion at one end of the bendable circuit sheet along a longitudinal direction of the glass lamp tube. The freely extending end portion is electrically connected to the power supply. The glass lamp tube and the end cap are secured by a hot melt adhesive.

In some embodiments, the bendable circuit sheet may be made of a metal layer structure.

In some embodiments, the thickness range of the metal layer structure may be 10 μm to 50 μm.

In some embodiments, the bendable circuit sheet may be a patterned wiring layer.

In some embodiments, the glass lamp tube may be coated with an anti-reflection layer with a thickness of one quarter of the wavelength range of light coming from the LED light source.

In some embodiments, the refractive index of the anti-reflection layer may be a square root of the refractive index of the glass lamp tube with a tolerance of ±20%.

The present invention also provides an LED tube lamp, according to one embodiment, including a glass lamp tube, an end cap, a power supply, and an LED light strip. The glass lamp tube is covered by a heat shrink sleeve with the thickness range of the heat shrink sleeve being 20 μm to 200 μm. At least part of the inner surface of the glass lamp tube is formed with a light scattering region. The glass lamp tube includes a main body region, a rear end region, and a two-arc-shaped transition region connecting the main body region and the rear end region. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet mounted on the inner surface of the glass lamp tube. The bendable circuit sheet electrically connects the LED light sources with the power supply, and the length of the bendable circuit sheet is larger than the length of the glass lamp tube to form a freely extending end portion at one end of the bendable circuit sheet along a longitudinal direction of the glass lamp tube. The freely extending end portion is electrically connected to the power supply. The glass lamp tube and the end cap are secured by a hot melt adhesive.

In some embodiments, the LED tube lamp further may include a reflective film disposed on a part of the inner surface where the light scattering region is not formed with.

In some embodiments, a ratio of a length of the reflective film disposed on the inner surface of the lamp tube extending along the circumferential direction of the glass lamp tube to a circumferential length of the glass lamp tube may be about 0.3 to 0.5.

The present invention provides another LED tube lamp, according to one embodiment, including a glass lamp tube, an end cap, a power supply, and an LED light strip. The glass lamp tube is covered by a heat shrink sleeve. At least part of the inner surface of the glass lamp tube is formed with a rough surface and the roughness of the inner surface is higher than that of the outer surface and the roughness of the inner surface is from 0.1 to 40 μm. The glass lamp tube includes a main body region, a rear end region, and a two-arc-shaped transition region connecting the main body region and the rear end region. The end cap is disposed at one end of the glass lamp tube and the power supply is provided inside the end cap. The LED light strip is disposed inside the glass lamp tube with a plurality of LED light sources mounted on the LED light strip. The LED light strip has a bendable circuit sheet mounted on the inner surface of the glass lamp tube. The bendable circuit sheet electrically connects the LED light sources with the power supply. The length of the bendable circuit sheet is larger than the length of the glass lamp tube to form a freely extending end portion at one end of the bendable circuit sheet along a longitudinal direction of the glass lamp tube. The freely extending end portion is electrically connected to the power supply. The glass lamp tube and the end cap are secured by a hot melt adhesive.

In some embodiments, the LED tube lamp may further include a reflective film disposed on a part of the inner surface where the rough surface is not formed with.

In some embodiments, a ratio of a length of the reflective film disposed on the inner surface of the lamp tube extending along the circumferential direction of the glass lamp tube to a circumferential length of the glass lamp tube may be about 0.3 to 0.5.

In the above-mentioned embodiments, the glass lamp tube includes the main body region, the rear end region, and the two-arc-shaped transition region connecting the main body region and the rear end region. Therefore, a height difference between the rear end region and the main body region is formed to avoid adhesives applied on the rear end region being overflowed onto the main body region, and thereby saves manpower for removing the overflowed adhesive and increases productivity. Since the glass lamp tube includes the two-arc-shaped transition region, the bendable circuit sheet is necessary such that it can be mounted on the inner surface of the glass lamp tube as well as extending into the end cap to be connected to the power supply.

The hot melt adhesive may be improved and the heating method of the hot melt adhesive may be well designed to facilitate secure connection between the glass lamp tube and the end caps such that the reliability of the hot melt adhesive could be prevented from decreasing due to high temperature caused inside the end cap. In addition, the hot melt adhesive may be used to electrically insulate the glass lamp tube and the end caps to further prevent from any possible electrical shock when the glass lamp tube is broken.

The heat shrink sleeve is capable of making the glass lamp tube electrically insulated. The heat shrink sleeve may be substantially transparent with respect to the wavelength of light from the LED light sources, such that only a slight part of the lights transmitting through the glass lamp tube is absorbed by the heat shrink sleeve.

The anti-reflection layer is capable of making more light from the LED light sources transmit through the glass lamp tube.

DETAILED DESCRIPTION OF PREFERRED EMBODIMENTS

The present disclosure provides a novel LED tube lamp based on the glass made lamp tube to solve the abovementioned problems. The present disclosure will now be described in the following embodiments with reference to the drawings. The following descriptions of various embodiments of this invention are presented herein for purpose of illustration and giving examples only. It is not intended to be exhaustive or to be limited to the precise form disclosed. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

"Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0% to 5% deviation around 0.1 and a 0% to 5% deviation around 1, especially if such deviation maintains the same effect as the listed range."

"Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein."

Figure 1:
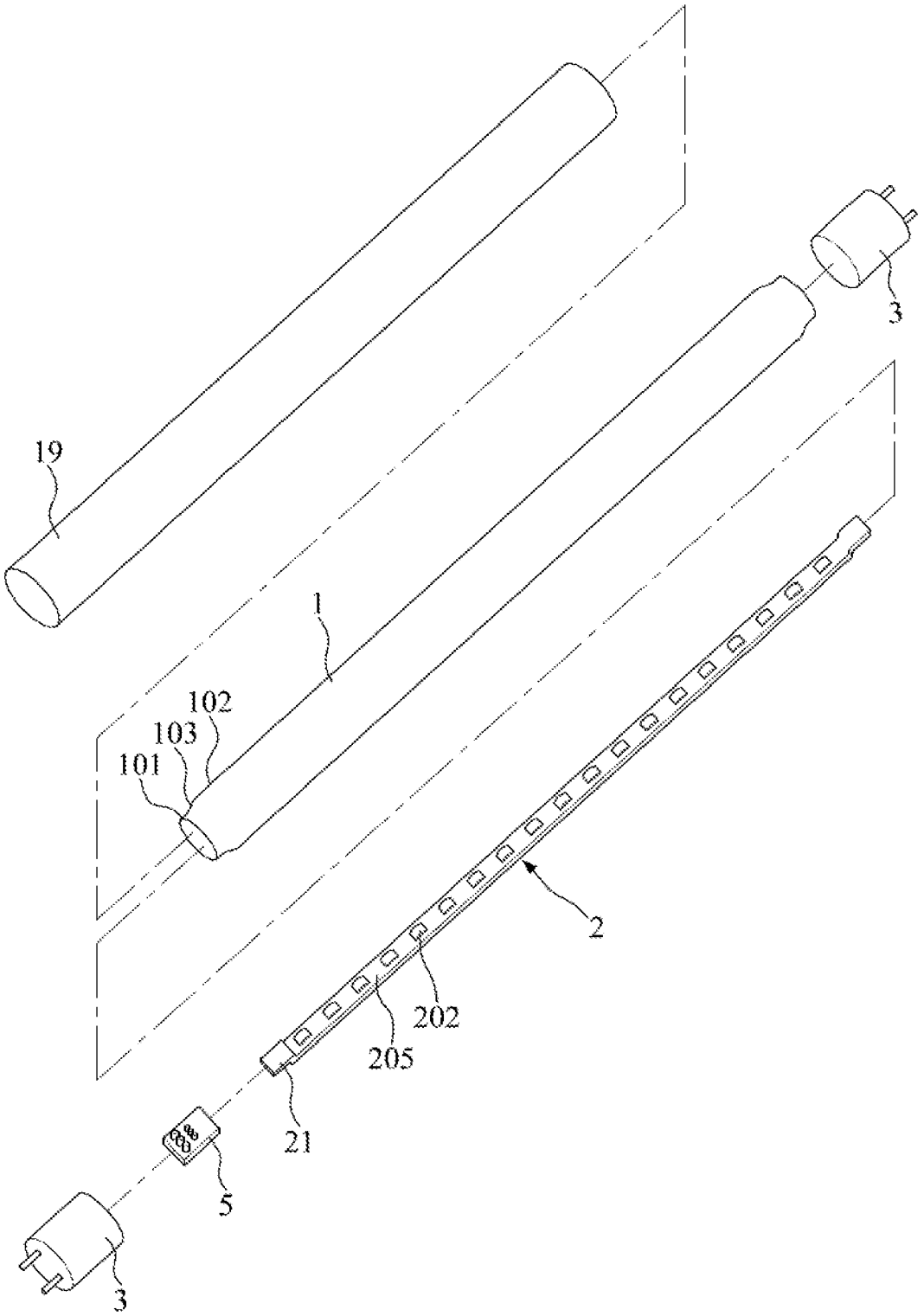
FIG. 1 is an exploded view schematically illustrating the LED tube lamp according to one embodiment of the present invention.

Referring to FIG. 1, an LED tube lamp in accordance with a first embodiment of the present invention includes a glass lamp tube 1, an LED light strip 2 disposed inside the glass lamp tube 1, and two end caps 3 respectively disposed at two ends of the glass lamp tube 1. The glass lamp tube 1 is made of glass and covered by a heat shrink sleeve 19. The heat shrink sleeve 19 is substantially transparent with respect to the wavelength of light from the LED light sources 202 and may be made of PFA (perfluoroalkoxy) or PTFE (poly tetra fluoro ethylene). The inner surface of the glass lamp tube 1 is formed with a rough surface and the roughness of the inner surface is higher than that of the outer surface, such that the light from the LED light sources 202 can be uniformly spread when transmitting through the glass lamp tube 1. Since LED light sources 202 consists of several point light sources (LED dies), each LED light source 202 casts a cone of light, which results in non-uniformity of light output intensity. With the rough surface, the light from LED light sources 202 will be diffused before transmitting through the glass lamp tube 1 and the uniformity of light output is improved.

One of the end caps 3 is disposed at one end of the glass lamp tube 1 and the power supply 5 is provided inside the end cap 3. In another embodiment, two power supplies 5 are respectively provided inside the two end caps 3. The LED light strip 2 is disposed inside the glass lamp tube 1 with a plurality of LED light sources 202 mounted on the LED light strip 2. The glass lamp tube 1 and each of the end caps 3 are secured by a hot melt adhesive disposed between an inner surface of each of the end caps 3 and outer surfaces of the rear end region 101 and the two-arc-shaped transition region 103. The hot melt adhesive is a composite including a so-called "welding mud powder". Therefore, each of the end caps 3 and the glass lamp tube 1 can be adhered closely by using the hot melt adhesive to accomplish automatic manufacture for the LED tube lamps. In one embodiment, the hot melt adhesive may be expansive and flowing and finally solidified after cooling. In one embodiment, the volume of the hot melt adhesive may expand to 1.3 times the original size when heated from room temperature to 200 or 250 Degrees Celsius. The hot melt adhesive is not limited to the materials recited herein. Alternatively, a material for the hot melt adhesive to be solidified immediately when heated to a predetermined temperature can be used. The hot melt adhesive provided in each embodiments of the present invention is durable with respect to high temperature inside the end caps 3 due to the heat resulted from the power supply. Therefore, the glass lamp tube 1 and the end caps 3 could be secured to each other without decreasing the reliability of the LED tube lamp.

Figure 2:
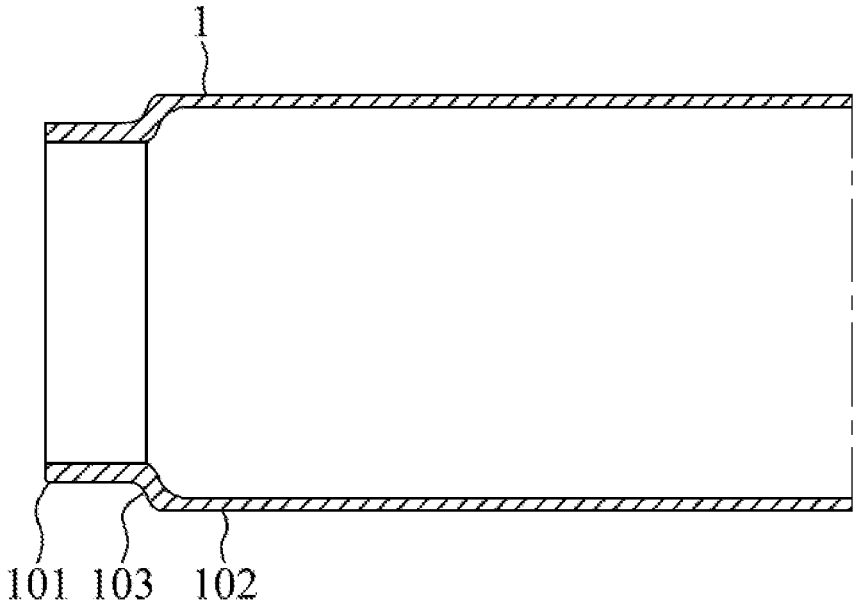
FIG. 2 is a plane cross-sectional view schematically illustrating end structure of a glass lamp tube of the LED tube lamp according to one embodiment of the present invention.

Referring to FIGS. 1 and 2, the glass lamp tube 1 includes a main body region 102, a rear end region 101, and a two-arc-shaped transition region 103 connecting the main body region and the rear end region 101. The outer diameter of the rear end region 101 is smaller than that of the main body region 102. Therefore, a height difference between the rear end region 101 and the main body region 102 is formed to avoid adhesives applied on the rear end region 101 being overflowed onto the main body region 102, and thereby saves manpower for removing the overflowed adhesive and increases productivity.

Figure 3:
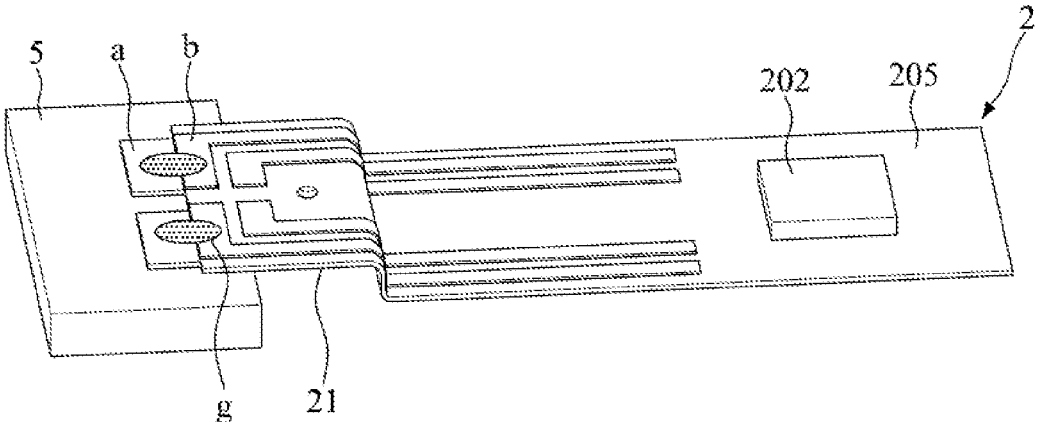
FIG. 3 is a perspective view schematically illustrating the soldering pad of the bendable circuit sheet of the LED light strip for soldering connection with the printed circuit board of the power supply of the LED tube lamp according to one embodiment of the present invention.

Referring to FIG. 3, the LED light strip 2 has a bendable circuit sheet 205 mounted on the inner surface of the glass lamp tube 1, and the bendable circuit sheet 205 electrically connects the LED light sources 202 with the power supply 5. The length of the bendable circuit sheet 205 is larger than the length of the glass lamp tube 1 to form a freely extending end portion 21 at one end of the bendable circuit sheet 205 along a longitudinal direction of the glass lamp tube 1 and the freely extending end portion 21 is electrically connected to the power supply 5. Specifically, the power supply 5 has soldering pads "a" which are capable of being soldered with the soldering pads "b" of the freely extending end portion 21 by soldering material "g".

Figure 4:
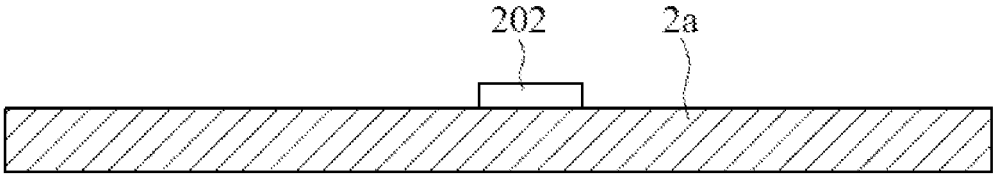
FIG. 4 is a plane cross-sectional view schematically illustrating a single-layered structure of the bendable circuit sheet of the LED light strip of the LED tube lamp according to an embodiment of the present invention.

Referring to FIG. 4, the bendable circuit sheet 205 may be made of a metal layer structure 2*a*. The thickness range of the metal layer structure 2*a* may be 10 μm to 50 μm and the metal layer structure 2*a* may be a patterned wiring layer.

The inner surface of the glass lamp tube 1 may be coated with an anti-reflection layer with a thickness of one quarter of the wavelength range of light coming from the LED light source 202. With the anti-reflection layer, more light from the LED light sources 202 can transmit through the glass lamp tube 1. In some embodiments, the refractive index of the anti-reflection layer is a square root of the refractive index of the glass lamp tube 1 with a tolerance of ±20%.

Referring to FIG. 1 again, an LED tube lamp in accordance with a second embodiment of the present invention includes a glass lamp tube 1, an LED light strip 2 disposed inside the glass lamp tube 1, and two end caps 3 respectively disposed at two ends of the glass lamp tube 1. The glass lamp tube 1 is made of glass and covered by a heat shrink sleeve 19. The heat shrink sleeve 19 has a thickness range between 20 μm and 200 μm and is substantially transparent with respect to the wavelength of light from the LED light sources 202. The heat shrink sleeve 19 may be made of PFA (perfluoroalkoxy) or PTFE (poly tetra fluoro ethylene).

Figure 5:
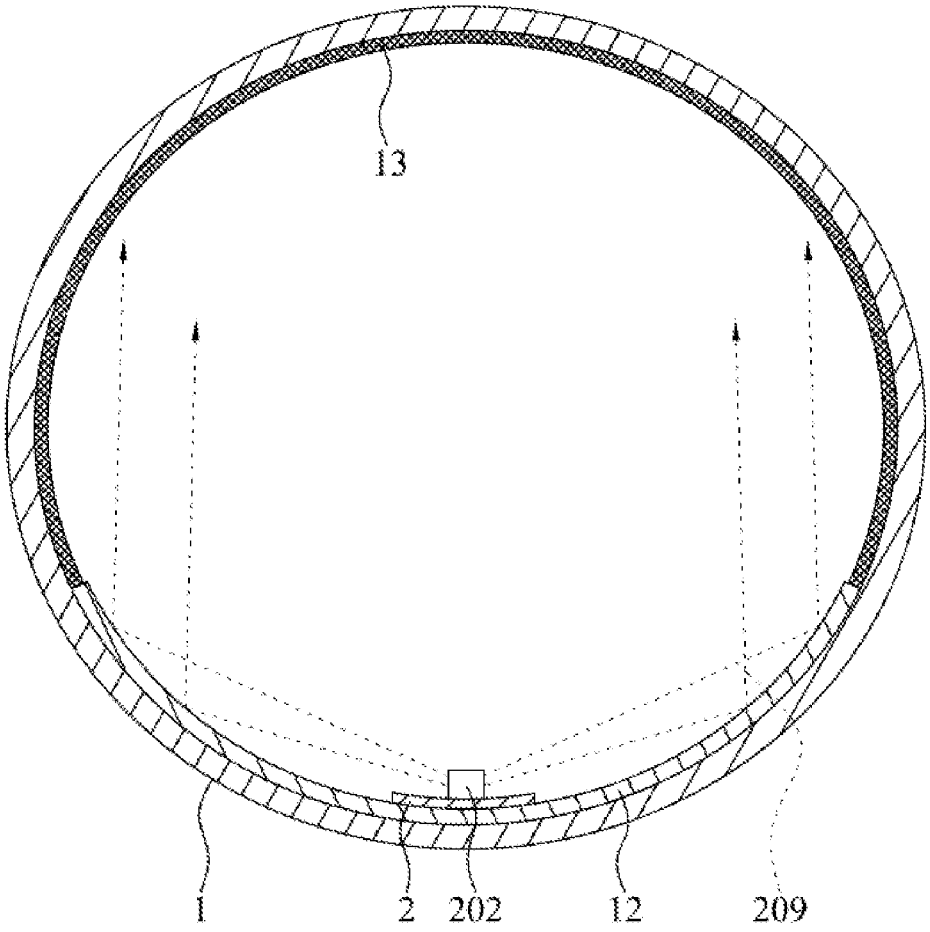
FIG. 5 is a plane cross-sectional view schematically illustrating inside structure of the glass lamp tube of the LED tube lamp according to one embodiment of the present invention, wherein two reflective films are respectively adjacent to two sides of the LED light strip along the circumferential direction of the glass lamp tube.

In this embodiment, the inner surface of the glass lamp tube 1 may be not formed with a rough surface. Instead, the inner surface of the glass lamp tube 1 may be partially or entirely formed with a light scattering region 13, as shown in FIG. 5. Since LED light sources 202 consists of several point light sources (LED dies), each LED light source 202 casts a cone of light, which results in non-uniformity of light output intensity. With the light scattering region 13, the light from LED light sources 202 will be scattered before transmitting through the glass lamp tube 1 and the uniformity of light output is substantially improved.

Referring to FIG. 2, in the second embodiment, the glass lamp tube 1 also includes a main body region 102, a rear end region 101, and a two-arc-shaped transition region 103 connecting the main body region 102 and the rear end region 101. The outer diameter of the rear end region 101 is smaller than that of the main body region 102.

Referring to FIG. 3, in the second embodiment, the LED light strip 2 has a bendable circuit sheet 205 mounted on the inner surface of the glass lamp tube 1, and the bendable circuit sheet 205 electrically connects the LED light sources 202 with the power supply 5. The length of the bendable circuit sheet 205 is larger than the length of the glass lamp tube 1 to form a freely extending end portion 21 at one end of the bendable circuit sheet 205 along a longitudinal direction of the glass lamp tube 1 and the freely extending end portion 21 is electrically connected to the power supply 5. Specifically, the power supply 5 has soldering pads "a" which are capable of being soldered with the soldering pads "b" of the freely extending end portion 21 by soldering material "g".

Referring to FIG. 4, in the second embodiment, the bendable circuit sheet 205 may be made of a metal layer structure 2*a*. The thickness range of the metal layer structure 2*a* may be 10 μm to 50 μm and the metal layer structure 2*a* may be a patterned wiring layer.

Referring to FIG. 5, in the second embodiment, the glass lamp tube 1 may further include a reflective film 12 disposed on a part of the inner surface of the glass lamp tube 1. In some embodiments, the reflective film 12 may be positioned on two sides of the LED light strip 2. And, in some embodiments, a ratio of a length of the reflective film 12 disposed on the inner surface of the glass lamp tube 1 extending along the circumferential direction of the glass lamp tube 1 to a circumferential length of the glass lamp tube 1 may be about 0.3 to 0.5, which means about 30% to 50% of the inner surface area may be covered by the reflective film 12. The reflective film 12 may be made of PET with some reflective materials such as strontium phosphate or barium sulfate or any combination thereof, with a thickness between about 140 μm and about 350 μm or between about 150 μm and about 220 μm for a more preferred effect in some embodiments. In some embodiments, only the part of the inner surface which is not covered by the reflective film 12 is formed with the light scattering region 13 as shown in FIG. 5. In other words, the reflective film 12 is disposed on a part of the inner surface of the glass lamp tube 1 which is not formed with the light scattering region 13.

Referring still to FIG. 1, an LED tube lamp in accordance with a third embodiment of the present invention includes a glass lamp tube 1, an LED light strip 2 disposed inside the glass lamp tube 1, and two end caps 3 respectively disposed at two ends of the glass lamp tube 1. The glass lamp tube 1 is made of glass and covered by a heat shrink sleeve 19. The heat shrink sleeve 19 is substantially transparent with respect to the wavelength of light from the LED light sources 202. The heat shrink sleeve 19 may be made of PFA (perfluoroalkoxy) or PTFE (poly tetra fluoro ethylene). The heat shrink sleeve 19 may be slightly larger than the glass lamp tube 1, and may be shrunk and tightly cover the outer surface of the glass lamp tube 1 while being heated to an appropriate temperature (ex, 260° C. for PFA and PTFE).

In this embodiment, the inner surface of the glass lamp tube 1 is partially or entirely formed with a rough surface and the roughness of the inner surface is higher than that of the outer surface and the roughness of the inner surface may be from 0.1 to 40 μm. Since LED light sources 202 consists of several point light sources (LED dies), each LED light source 202 casts a cone of light, which results in non-uniformity of light output intensity. By making the roughness of the inner surface is 0.1 to 40 μm higher than that of the outer surface, the light from LED light sources 202 will be well diffused before transmitting through the glass lamp tube 1 and the uniformity of light output is substantially improved.

Referring to FIG. 2, in the third embodiment, the glass lamp tube 1 also includes a main body region 102, a rear end region 101, and a two-arc-shaped transition region 103 connecting the main body region 102 and the rear end region 101. The outer diameter of the rear end region 101 is smaller than that of the main body region 102.

Referring to FIG. 3, in the third embodiment, the LED light strip 2 has a bendable circuit sheet 205 mounted on the inner surface of the glass lamp tube 1, and the bendable circuit sheet 205 electrically connects the LED light sources 202 with the power supply 5. The length of the bendable circuit sheet 205 is larger than the length of the glass lamp tube 1 to form a freely extending end portion 21 at one end of the bendable circuit sheet 205 along a longitudinal direction of the glass lamp tube 1 and the freely extending end portion 21 is electrically connected to the power supply 5. Specifically, the power supply 5 has soldering pads "a" which are capable of being soldered with the soldering pads "b" of the freely extending end portion 21 by soldering material "g".

Referring to FIG. 4, in the third embodiment, the bendable circuit sheet 205 may be made of a metal layer structure 2*a*. The thickness range of the metal layer structure 2*a* may be 10 μm to 50 μm and the metal layer structure 2*a* may be a patterned wiring layer.

Referring to FIG. 5, in the third embodiment, the glass lamp tube 1 may further include a reflective film 12 disposed on a part of the inner surface of the glass lamp tube 1. In some embodiments, two reflective films 12 are respectively positioned on two sides of the LED light strip 2. As shown in FIG. 5, part of light 209 from LED light sources 202 are reflected by the reflective films 12 such that the light 209 from the LED light sources 202 can be centralized to a determined direction. In some embodiments, a ratio of a length of the reflective film 12 disposed on the inner surface of the glass lamp tube 1 extending along the circumferential direction of the glass lamp tube 1 to a circumferential length of the glass lamp tube 1 may be about 0.3 to 0.5, which means about 30% to 50% of the inner surface area may be covered by the reflective film 12. The reflective film 12 may be made of PET with some reflective materials such as strontium phosphate or barium sulfate or any combination thereof, with a thickness between about 140 μm and about 350 μm or between about 150 μm and about 220 μm for a more preferred effect in some embodiments. In some embodiments, only the part of the inner surface which is not covered by the reflective film 12 is formed with the rough surface. In other words, the reflective film 12 is disposed on a part of the inner surface of the glass lamp tube 1 which is not formed with the rough surface. The above-mentioned features of the present invention can be accomplished in any combination to improve the LED tube lamp, and the above embodiments are described by way of example only. The present invention is not herein limited, and many variations are possible without departing from the spirit of the present invention and the scope as defined in the appended claims.

What is claimed is:

1. An LED tube lamp, comprising:

a glass lamp tube covered by a heat shrink sleeve, wherein the inner surface of the glass lamp tube is formed with a rough surface and the roughness of the inner surface is higher than that of the outer surface, and the glass lamp tube comprises a main body region, a rear end region, and a two-arc-shaped transition region connecting the main body region and the rear end region;

an end cap disposed at one end of the glass lamp tube;

a power supply provided inside the end cap; and an LED light strip disposed inside the glass lamp tube with a plurality of LED light sources mounted on the LED light strip;

wherein the LED light strip has a bendable circuit sheet mounted on an inner surface of the glass lamp tube to electrically connect the LED light sources with the power supply, the length of the bendable circuit sheet is larger than the length of the glass lamp tube to form a freely extending end portion at one end of the bendable circuit sheet along a longitudinal direction of the glass lamp tube, the freely extending end portion is electrically connected to the power supply, and the glass lamp tube and the end cap are secured by a hot melt adhesive.

2. The LED tube lamp of claim 1, wherein the bendable circuit sheet is made of a metal layer structure.

3. The LED tube lamp of claim 2, wherein the thickness range of the metal layer structure is 10 μm to 50 μm.

4. The LED tube lamp of claim 3, wherein the metal layer structure is a patterned wiring layer.

5. The LED tube lamp of claim 1, wherein the glass lamp tube is coated with an anti-reflection layer with a thickness of one quarter of the wavelength range of light coming from the LED light source.

6. The LED tube lamp of claim 5, wherein the refractive index of the anti-reflection layer is a square root of the refractive index of the glass lamp tube with a tolerance of ±20%.

7. The LED tube lamp of claim 1, wherein the heat shrink sleeve is substantially transparent with respect to the wavelength of light from the LED light sources.

8. An LED tube lamp, comprising:

a glass lamp tube covered by a heat shrink sleeve with the thickness range of the heat shrink sleeve being 20 μm to 200 μm, wherein at least part of the inner surface of the glass lamp tube is formed with a light scattering region, and the glass lamp tube comprises a main body region, a rear end region, and a two-arc-shaped transition region connecting the main body region and the rear end region;

an end cap disposed at one end of the glass lamp tube;

a power supply provided inside the end cap; and an LED light strip disposed inside the glass lamp tube with a plurality of LED light sources mounted on the LED light strip;

wherein the LED light strip has a bendable circuit sheet mounted on an inner surface of the glass lamp tube to electrically connect the LED light sources with the power supply, the length of the bendable circuit sheet is larger than the length of the glass lamp tube to form a freely extending end portion at one end of the bendable circuit sheet along a longitudinal direction of the glass lamp tube, the freely extending end portion is electrically connected to the power supply, and the glass lamp tube and the end cap are secured by a hot melt adhesive.

9. The LED tube lamp of claim 8, further comprising a reflective film disposed on a part of the inner surface of the glass lamp tube which is not formed with the light scattering region.

10. The LED tube lamp of claim 9, wherein a ratio of a length of the reflective film disposed on the inner surface of the glass lamp tube extending along the circumferential direction of the glass lamp tube to a circumferential length of the lamp tube is about 0.3 to 0.5.

11. The LED tube lamp of claim 8, wherein the bendable circuit sheet is made of a metal layer structure.

12. The LED tube lamp of claim 11, wherein the metal layer structure is a patterned wiring layer.

13. The LED tube lamp of claim 8, wherein the heat shrink sleeve is substantially transparent with respect to the wavelength of light from the LED light sources.

14. An LED tube lamp, comprising:

a glass lamp tube covered by a heat shrink sleeve, wherein the inner surface of the glass lamp tube is formed with a rough surface and the roughness of the inner surface is higher than that of the outer surface and the roughness of the inner surface is from 0.1 to 40 μm, and the glass lamp tube comprises a main body region, a rear end region, and a two-arc-shaped transition region connecting the main body region and the rear end region;

an end cap disposed at one end of the glass lamp tube;

a power supply provided inside the end cap; and an LED light strip disposed inside the glass lamp tube with a plurality of LED light sources mounted on the LED light strip;

wherein the LED light strip has a bendable circuit sheet mounted on the inner surface of the glass lamp tube to electrically connect the LED light sources with the power supply, the length of the bendable circuit sheet is larger than the length of the glass lamp tube to form a freely extending end portion at one end of the bendable circuit sheet along a longitudinal direction of the glass lamp tube, the freely extending end portion is electrically connected to the power supply, and the glass lamp tube and the end cap are secured by a hot melt adhesive.

15. The LED tube lamp of claim 14, further comprising a reflective film disposed on a part of the inner surface of the glass lamp tube which is not formed with the rough surface.

16. The LED tube lamp of claim 15, wherein a ratio of a length of the reflective film disposed on the inner surface of the lamp tube extending along the circumferential direction of the lamp tube to a circumferential length of the lamp tube is about 0.3 to 0.5.

17. The LED tube lamp of claim 14, wherein the bendable circuit sheet is made of a metal layer structure.

18. The LED tube lamp of claim 17, wherein the metal layer structure is a patterned wiring layer.

19. The LED tube lamp of claim 14, wherein the glass lamp tube is coated with an anti-reflection layer with a thickness of one quarter of the wavelength range of light coming from the LED light source, and the refractive index of the anti-reflection layer is a square root of the refractive index of the glass lamp tube with a tolerance of ±20%.

20. The LED tube lamp of claim 14, wherein the heat shrink sleeve is substantially transparent with respect to the wavelength of light from the LED light sources.

* * * * *